US010919669B2

(12) United States Patent
Yen

(10) Patent No.: US 10,919,669 B2
(45) Date of Patent: Feb. 16, 2021

(54) PACKAGING BOX

(71) Applicant: INTERNATIONAL DESIGN PACKING CO., LTD., Suzhou (CN)

(72) Inventor: Wentai Yen, Suzhou (CN)

(73) Assignee: INTERNATIONAL DESIGN PACKING CO., LTD., Suzhou (CN)

( * ) Notice: Subject to any disclaimer, the term of this patent is extended or adjusted under 35 U.S.C. 154(b) by 204 days.

(21) Appl. No.: 16/093,140

(22) PCT Filed: Sep. 12, 2017

(86) PCT No.: PCT/CN2017/101408
§ 371 (c)(1),
(2) Date: Oct. 11, 2018

(87) PCT Pub. No.: WO2018/188261
PCT Pub. Date: Oct. 18, 2018

(65) Prior Publication Data

US 2019/0375550 A1 Dec. 12, 2019

(30) Foreign Application Priority Data

Apr. 14, 2017 (CN) ..... 201720396082.5

(51) Int. Cl.

| | |
|---|---|
| ***B65D 25/04*** | (2006.01) |
| ***B65D 5/42*** | (2006.01) |
| ***B65D 81/05*** | (2006.01) |
| ***B65D 85/30*** | (2006.01) |

(52) U.S. Cl.
CPC ..... *B65D 25/04* (2013.01); *B65D 5/4204* (2013.01); *B65D 81/05* (2013.01); *B65D 85/30* (2013.01)

(58) Field of Classification Search
CPC ..... B65D 5/4204; B65D 25/04; B65D 81/05; B65D 85/30
USPC ..... 220/553
See application file for complete search history.

(56) References Cited

U.S. PATENT DOCUMENTS

| | | | | |
|---|---|---|---|---|
| 3,101,880 A * | 8/1963 | Peterson | ..... | B65D 5/5495 229/120.012 |
| 6,244,502 B1 * | 6/2001 | Hollar | ..... | B65D 5/48048 229/117.16 |
| 2005/0167292 A1 | 8/2005 | Sutherland | | |

FOREIGN PATENT DOCUMENTS

| | | |
|---|---|---|
| CN | 101155737 A | 4/2008 |
| CN | 102874494 A | 1/2013 |
| JP | 2012210981 A | 11/2012 |

(Continued)

OTHER PUBLICATIONS

International Search Report and Written Opinion dated Jan. 18, 2018 for PCT/CN2017/101408.

*Primary Examiner* — King M Chu
(74) *Attorney, Agent, or Firm* — Brown Rudnick LLP

(57) ABSTRACT

A packaging box includes a box body; a box cover integrally formed with the box body; and at least one baffle arranged inside a cavity of the box body, the at least one baffle divides the cavity of the box body into at least two cavities; the box body is integrally press-formed from a plate provided with a plurality of bending dents; and each of the at least one baffle is formed by bonding of adjacent side walls of two adjacent quadrilateral positioning frames, and an extension wall for positioning the quadrilateral positioning frames is foldable and disposed at each of a first side wall of the box body and a second side wall of the box body.

6 Claims, 2 Drawing Sheets

(56) References Cited

FOREIGN PATENT DOCUMENTS

JP 2016120924 A 7/2016

* cited by examiner

PACKAGING BOX

CROSS-REFERENCES TO RELATED APPLICATIONS

This application is a national stage application under 35 U.S.C. 371 based on international patent application PCT/CN2017/101408, filed on Sep. 12, 2017 which claims priority to a Chinese patent application No. 201720396082.5 filed on Apr. 14, 2017, disclosures of both of which are incorporated herein by reference in their entireties.

TECHNICAL FIELD

The present disclosure relates to the technical field of packaging, for example, to a packaging box.

BACKGROUND

The wine bottles or other objects may easily collide with each other and cause damages in transit when they are packaged in pairs in a packaging box in the related art.

SUMMARY

A packaging box provided in the disclosure is easy to be assembled and can effectively prevent collision between adjacent packaged objects.

A packaging box is provided. The packaging box includes a box body; a box cover integrally formed with the box body; and at least one baffle arranged inside a cavity of the box body, the at least one baffle divides the cavity of the box body into at least two cavities; the box body is integrally press-formed from a plate provided with a plurality of bending dents; and each of the at least one baffle is formed by bonding of adjacent side walls of two adjacent quadrilateral positioning frames, and an extension wall for positioning the quadrilateral positioning frames is foldable and disposed at each of a first side wall of the box body and a second side wall of the box body.

In an embodiment, the number of the at least one baffle is one and the one baffle divides the cavity of the box body into two cavities.

In an embodiment, the extension wall is folded into the cavity of the box body, an end of the extension wall is contacted with a bottom of the box, and the bottom of the box faces to the box cover.

In an embodiment, a first side wall of each of the quadrilateral positioning frames is disposed between the extension wall and the first side wall of the box body.

In an embodiment, a second side wall of each of the quadrilateral positioning frames is disposed between the extension wall and the second side wall of the box body.

In an embodiment, the box cover is provided with a transparent window along a lengthwise direction of the box, and when the box cover is closed, an orthographic projection of the transparent window on the bottom of the box is located in an area enclosed by an orthographic projection of the quadrilateral positioning frames on the bottom of the box.

In an embodiment, the transparent window is an opening which is sealed with a transparent film.

By the packaging box provided in the disclosure, the quadrilateral positioning frames can be easily positioned by the extension wall, the baffle is formed by the adjacent side walls of two quadrilateral positioning frames, and the baffle divides the cavity of the box body and increase buffering to prevent the collision between the adjacent packaged objects, effectively promoting reliability of product packaging.

DETAILED DESCRIPTION

The solutions of the present disclosure are described hereinafter through an embodiment in conjunction with the accompanying drawings.

Figure 1:
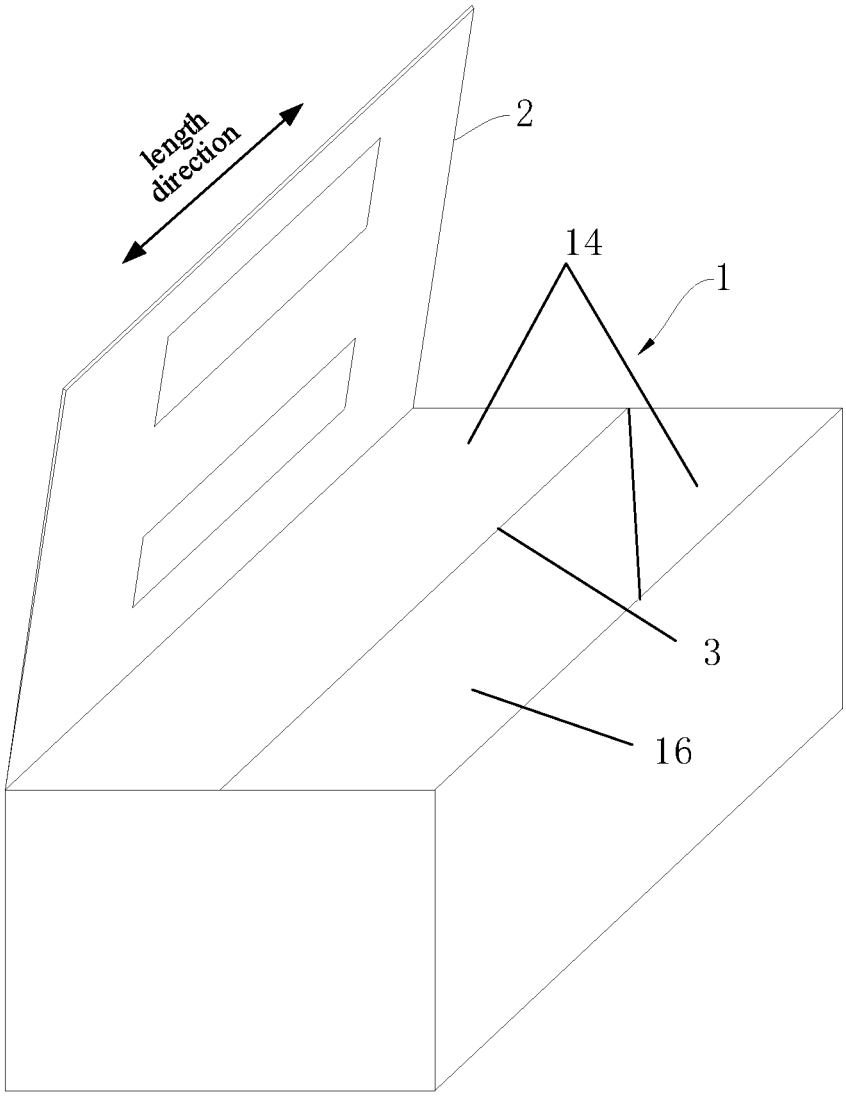
FIG. 1 is an axonometric drawing of a packaging box according to an embodiment.
Figure 2:
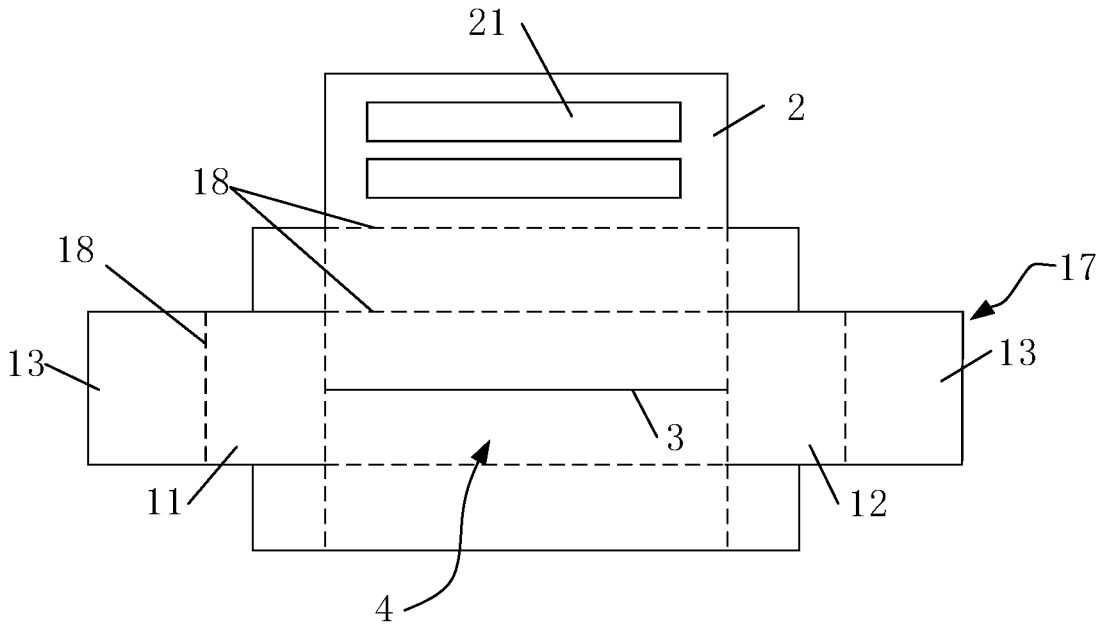
FIG. 2 is a plan view of an unfolded structure of FIG. 1.

As shown in FIG. 1 and FIG. 2, this embodiment provides a packaging box that includes a box body 1, a box cover 2 integrally formed with the box body 1, and at least one baffle 3 arranged inside a cavity 14 of the box body 1. The at least one baffle 3 divides the cavity 14 of the box body 1 into at least two cavities.

Optionally, one or more baffles 3 are arranged in the cavity 14 of the box body 1. The embodiment takes one baffle arranged in the cavity 14 of the box body 1 as an example to illustrate. When multiple baffles are disposed in the cavity 14 of the box body 1, the multiple baffles 3 divide the cavity 14 of box body 1 into multiple cavities.

The box body 1 is integrally press-formed from a plate provided with a plurality of bending dents 18.

The at least one baffle 3 is formed by bonding adjacent side walls 16 of two adjacent quadrilateral positioning frames 4, and an extension wall for positioning the quadrilateral positioning frames 4 is foldable and disposed at each of a first side wall 11 of the box body 1 and a second side wall 12 of the box body 1.

The extension wall 13 is folded into the cavity 14 of the box body, and an end 17 of the extension wall 13 is contacted with a bottom of the box, and the bottom of the box is disposed opposite to the box cover. A first side wall of each of the quadrilateral positioning frames 4 is disposed between the extension wall 13 and the first side wall 11 of the box body 1. A second side wall of each of the quadrilateral positioning frames 4 is disposed between the extension wall 13 and the second side wall 12 of the box body.

Each extension wall 13 consists of two parts. Each of the parts is used for positioning a respective one of the two quadrilateral positioning frames 4.

The box cover 2 is provided with a transparent window 21 along a lengthwise direction of the box, and when the box cover is closed, an orthographic projection of the transparent window 21 on the bottom of the box is located in an area enclosed by an orthographic projection of the quadrilateral positioning frames 4 on the bottom of the box.

The transparent window 21 is sealed with a transparent film.

When the packaging box provided with the above-mentioned structure is adopted, the quadrilateral positioning frames 4 can be easily positioned by the extension wall 13, the baffle 3 is formed by the adjacent side walls of two quadrilateral positioning frames 4, and the baffle 3 divides the cavity 14 of the box body and increase buffering to prevent the collision between the adjacent packaged objects, effectively promoting reliability of product packaging.

In the related art, a well-finished box has a three-dimensional structure and cannot be spread out, causing a high transportation cost. The packaging box in the embodiment can be spread out so as to have a minimum volume when in transit after finished, thereby ensuring transport security and saving shipping cost in the process of transporting to a user.

What is claimed is:

1. A packaging box, comprising: a box body; a box cover integrally formed with the box body; and at least one baffle arranged inside a cavity of the box body, wherein the at least one baffle divides the cavity of the box body into at least two cavities;

wherein the box body is integrally press-formed from a plate provided with a plurality of bending dents; and each of the at least one baffle is formed by bonding of adjacent side walls of two adjacent quadrilateral positioning frames, and an extension wall for positioning the quadrilateral positioning frames is foldable and disposed at each of a first side wall of the box body and a second side wall of the box body;

wherein the extension wall is folded into the cavity of the box body, an end of the extension wall is contacted with a bottom of the box, and the bottom of the box faces to the box cover.

2. The packaging box according to claim 1, wherein the number of the at least one baffle is one and the one baffle divides the cavity of the box body into two cavities.

3. The packaging box according to claim 1, wherein a first side wall of each of the quadrilateral positioning frames is disposed between the extension wall and the first side wall of the box body.

4. The packaging box according to claim 1, wherein a second side wall of each of the quadrilateral positioning frames is disposed between the extension wall and the second side wall of the box body.

5. The packaging box according to claim 1, wherein the box cover is provided with a transparent window along a length direction of the box, and when the box cover is closed, an orthographic projection of the transparent window on the bottom of the box is located in an area enclosed by an orthographic projection of the quadrilateral positioning frames on the bottom of the box.

6. The packaging box according to claim 5, wherein the transparent window is an opening which is sealed with a transparent film.

* * * * *